US008925116B2

(12) United States Patent
Augustine et al.

(10) Patent No.: US 8,925,116 B2
(45) Date of Patent: Jan. 6, 2015

(54) ACCESSORY FOR SHOE LACES, HAT BRIMS, AND THE LIKE

(76) Inventors: Thomas R. Augustine, Powell, OH (US); Douglas Frank Stitt, Westerville, OH (US); Randy James, Worthington, OH (US); Poormehr Honarmand, Columbus, OH (US)

( * ) Notice: Subject to any disclaimer, the term of this patent is extended or adjusted under 35 U.S.C. 154(b) by 595 days.

(21) Appl. No.: 11/071,837

(22) Filed: Mar. 3, 2005

(65) Prior Publication Data

US 2006/0107447 A1 May 25, 2006

Related U.S. Application Data

(60) Provisional application No. 60/630,891, filed on Nov. 24, 2004.

(51) Int. Cl.

| | |
|---|---|
| ***A41D 31/00*** | (2006.01) |
| ***A43B 3/00*** | (2006.01) |
| ***A43C 9/02*** | (2006.01) |

(52) U.S. Cl.

CPC ..... *A63B 23/24* (2013.01); *A43B 3/0078* (2013.01); *A43C 9/02* (2013.01)

USPC ..... 2/243.1

(58) Field of Classification Search

USPC ..... 2/243.1, 245; 24/712, 712.1, 712.4, 24/712.5; 36/136; 40/636; 283/75

See application file for complete search history.

(56) References Cited

U.S. PATENT DOCUMENTS

| | | | | |
|---|---|---|---|---|
| 5,195,783 | A * | 3/1993 | Lavoie | 283/75 |
| 6,477,754 | B1 * | 11/2002 | Alexander | 24/712 |
| 6,651,362 | B2 * | 11/2003 | Caveney | 40/316 |

* cited by examiner

*Primary Examiner* — Tejash Patel

(74) *Attorney, Agent, or Firm* — Kegler Brown Hill & Ritter; James J. Pingor

(57) ABSTRACT

A decorative and/or promotional accessory to be secured to a lace such as a shoe lace includes a molded plastic body having a passage longitudinally extending therethrough from a first opening to a second opening. The passage is sized and shaped to receive the lace therethrough and to frictionally secure the body in a desired position along the lace. The accessory also includes indicia provided on an exterior surface of the accessory which can be in the form of any desired message, name, number, logo, graphic, or the like. An alternative embodiment of the accessory is disclosed which is to be secured to a cap bill. This embodiment includes a slot radially extending to the passage which is sized and shaped to receive the cap brim therein and to resiliently grip the bill and removably secure the accessory in a desired position along the bill.

20 Claims, 5 Drawing Sheets

Patent Law Group LLP

ACCESSORY FOR SHOE LACES, HAT BRIMS, AND THE LIKE

CROSS-REFERENCE TO RELATED APPLICATIONS

This non-provisional patent application claims priority benefit of U.S. provisional patent application No. 60/630,891 filed on Nov. 24, 2004, the disclosure of which is expressly incorporated herein in its entirety by reference.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to a decorative and/or promotional accessory and, more particularly, to a decorative and/or promotional accessory to be secured to shoe laces, cap brims, and the like.

BACKGROUND OF THE INVENTION

A growing trend among teenagers, young adults, and even older adults is to wear affordable accessories reflecting socially conscious messages. For example, the "Live Strong" bracelets which promote cancer awareness and are in demand over the entire world. These low-cost promotional accessories can be leveraged by charities, businesses, schools, athletic programs, teams, celebrities, or other organizations and individuals to build awareness for their cause and/or products or services by providing a desirable, fashionable incentive for lower-bracket donations. Additionally, these low-cost promotional items can also be sold as low-cost fund raising products or given away as promotional items. Furthermore, these low cost items can simply be decorative accessories having a desired name, number, logo or graphic.

Bracelets have limited usage in that they can only be worn in one place and in one way. Additionally, bracelets cannot be worn at all in some circumstances such as, for example, schools or athletic events which do not permit "jewelry" to be worn. Accordingly, there is a need for an improved decorative and/or promotional accessory.

SUMMARY OF THE INVENTION

The present invention provides a decorative and/or promotional accessory which solves at least some of the above-noted problems. In accordance with one aspect of the present invention, an accessory to be secured to a lace comprises, in combination, a molded plastic body having a passage longitudinally extending therethrough from a first opening to a second opening. The passage is sized and shaped to receive the lace therethrough and to frictionally secure the body in a desired position along the lace. The accessory further comprises indicia provided on an exterior surface of the accessory.

According to another aspect of the present invention, a shoe comprises, in combination, a lace and an accessory including a molded plastic body having a passage. longitudinally extending therethrough from a first opening to a second opening. The passage receives the lace therethrough to frictionally secure the body in a desired position along the lace. The accessory further comprises indicia provided on an exterior surface of the accessory.

According to another aspect of the present invention, an accessory to be secured to a cap bill comprises, in combination, a molded plastic body having a passage longitudinally extending therethrough and a slot radially extending to the passage. The slot is sized and shaped to receive the cap brim therein to resiliently grip the bill and removably secure the body in a desired position along the cap bill. The accessory further comprises indicia provided on an exterior surface of the accessory.

According to another aspect of the present invention, a cap comprises, in combination, a bill with an edge and an accessory including a molded plastic body having a passage longitudinally extending therethrough and a slot radially extending to the passage. The slot receives the edge of the cap bill therein to removably secure the accessory in a desired position along the cap bill. The accessory further comprises indicia provided on an exterior surface of the accessory.

From the foregoing disclosure and the following more detailed description of various preferred embodiments it will be apparent to those skilled in the art that the present invention provides a significant advance in the technology and art of decorative and/or promotional accessories. Particularly significant in this regard is the potential the invention affords for providing a high quality, durable, aesthetically pleasing, versatile, and relatively inexpensive accessory. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 2:
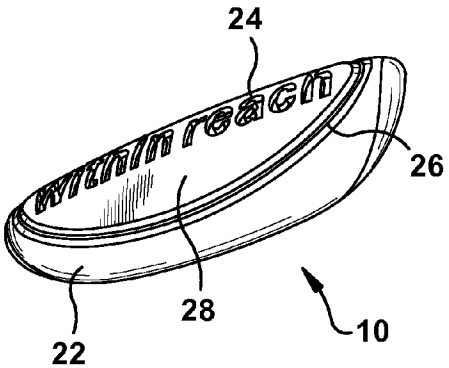
FIG. 2 is a perspective view of the decorative and/or promotional accessory of FIG. 1 according to a first preferred embodiment of the present invention.

It should be understood that the appended drawings are not necessarily to scale, presenting a somewhat simplified representation of various preferred features illustrative of the basic principles of the invention. The specific design features of a decorative and/or promotional accessory as disclosed herein, including, for example, specific messages, dimensions, orientations, and shapes will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the decorative and/or promotional accessory illustrated in the drawings.

DETAILED DESCRIPTION OF CERTAIN PREFERRED EMBODIMENTS

It will be apparent to those skilled in the art, that is, to those who have knowledge or experience in this area of technology, that many uses and design variations are possible for the decorative and/or promotional accessory disclosed herein. The following detailed discussion of various alternative and preferred embodiments will illustrate the general principles of the invention with reference to an accessory for attachment to a shoe lace for promoting awareness of juvenile diabetes by providing the inspirational message "within reach." Other embodiments suitable for other applications will be apparent to those skilled in the art given the benefit of this disclosure such as, for example, the accessory can be for attachment to any item which employs a lace, string, cord or tie such as, but not limited to shoes, boots, backpacks, zipper pulls, draw strings and the like or to any item which has a relatively thin edge of material such as but not limited to the brim of a hat or cap.

Figure 1:
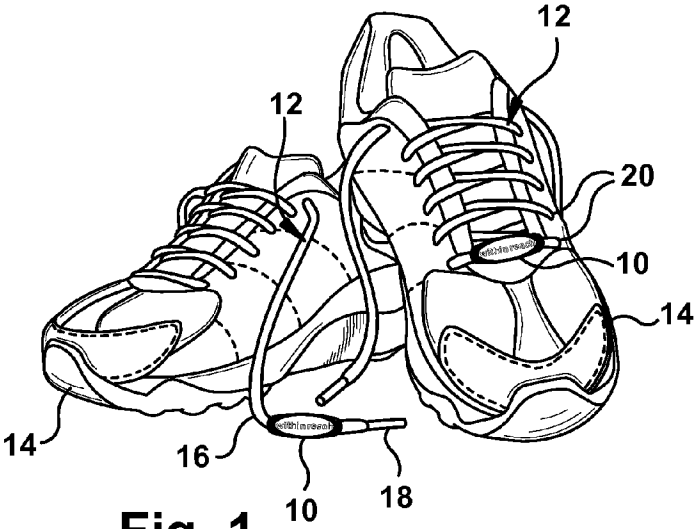
FIG. 1 is a perspective view of a pair of shoes each having a decorative and/or promotional accessory according to the present invention.

FIG. 1 illustrates a pair of decorative and/or promotional articles or accessories 10 according to a first embodiment of the present invention. The illustrated accessories 10 are secured to laces 12 of a pair of shoes 14. The illustrated laces 12 each include an elongate, flexible main portion 16 and hard, rigid end portions 18 having a smaller cross-sectional size than the main portion. The illustrated laces 12 extend through eyelets 20 of the shoes 14 in a standard manner so that free ends of the laces 12 can be tied to secure the shoes 14 onto a wearer's feet. One of the accessories 10 is secured near the end portion 18 of one of the laces 12. The other one of the accessories 10 is secured near the center of one of the laces 12 and between the lowest pair of the shoe eyelets 20. However, the accessories 10 can alternatively be secured at any desired location along the length of the laces 12. The term "lace" as used within this specification and claims means a long, thin, flexible member such as a lace, cord, string, or tie typically used for fastening, tying or lacing. It is noted that the illustrated accessories 10 can alternatively be secured any suitable type of laces other than shoe laces such as, for example, zipper pulls, hair bands, backpack cords, bracelets, necklaces, ankle bracelets, pins, swimsuit ties, bookmarks, outdoor equipment (camping, tents, draw strings, etc.), and athletic bag ties. The illustrated accessories 10 are identical so only one will be described hereinafter in detail.

As best shown in FIGS. 2 to 7, the illustrated accessory 10 includes a body 22 which is generally elongate and cylindrically shaped. The body 22 has a maximum length preferably in the range of about 1.0 to about 1.8 inches, more preferably in the range of about 1.2 to about 1.6 inches, and most preferably about 1.4 inches. Ends of the illustrated body are angled or chamfered so that a lower side of the body 22 has a length which is shorter than the upper side of the body 22. The lower side of the body 22 preferably has a length of about 0.5 inches. The body 22 has a maximum height preferably in the range of about 0.3 to 0.5 inches, more preferably in the range of about 0.35 to 0.45 inches and most preferably about 0.4 inches. The body 22 has a maximum width preferably in the range of about 0.35 to about 0.55 inches, more preferably about 0.4 to 0.5 inches, and most preferably about 0.45 inches. The upper or top side of the illustrated body 22 has a radius which is larger then the radius of the lower or bottom side so that a top side is broader and/or flatter than the bottom side. Formed in this manner, indicia 24 provided on the curved upper side is easier to see without distortion, particularly when large alphanumeric characters are utilized. The illustrated body 22 has an upper surface radius of about 0.250 inches and a lower radius of about 0.226 inches. The illustrated upper side of the body 22 is provided with groove 26 to define a generally-oval shaped exterior indicia surface 28 on the upper exterior side of the body.

The indicia surface 28 is provided with the desired indicia or message 24 to be promoted such as, for example, the illustrated phrase "within reach". The indicia 24 can be any desired alphanumeric indicia such as, for example, names, numbers, words, phrases, messages, or the like and/or graphic indicia such as, for example, logos, graphics, designs, or the like. The indicia 24 can be related to, but not limited to, any inspirational, charity, brand, school, team, athletic, or other message which suits the needs of any charity, business, school, athletic program, team, celebrity, or other organization or individual. The indicia 24 also can simply be provided for decorative purposes. The illustrated indicia 24 is molded into the exterior surface of the body 22 in debossed form, that is, recessed into the indicia surface 28. It is noted that the indicia 24 can alternatively be molded in an embossed manner, that is, raised above the indicia surface 28. It is also noted that the indicia or message 24 can alternatively be provided by any other suitable method such as, for example, pad printing or other printing. The illustrated lower side of the body 22 is also provided with a lower or second indicia or message 30 molded in an embossed manner. It is noted that the second indicia 30 can alternatively be omitted or formed in a different manner.

A longitudinally extending channel or passage 32 extends through the entire length of the body 22 for receiving the lace 12 therethrough. The passage 32 is sized and shaped to removably secure the body 22 in a desired position along the length of the lace 12 by providing a tight fit therebetween so that the body 22 is held in place by friction. The illustrated passage 32 has a first opening or inlet 34 at one end of the body 22 so that a first portion 36 of the passage 32 has a first diameter and a second opening or outlet 38 at the other end so that a second portion 40 of the passage 32 has a second diameter where the first diameter is larger than the second diameter. The illustrated passage 32 has an angled or tapered portion 42 which is frusto-conically shaped to smoothly connect the first and second portions 36, 40 to eliminate abutments upon which the end of the lace 12 could "catch" when inserted into the passage 32. The diameter of the first portion 36 is preferably sized so that the lace 12 can be easily passed therethrough while the diameter of the second portion 40 is preferably sized so that there is a tight fit with the lace 12 so that some force must be exerted to move the lace 12 therethrough. The illustrated first portion 36 has a diameter of about 0.216 inches and the illustrated second portion 40 has a diameter of about 0.138 inches. It is noted that while the illustrated passage 32 has a circular cross-sectional shape, the passage can alternatively have any other suitable cross-sectional shape. The second portion 40 of the passage preferably has a length which permits the lace end portion 18 to extend therethrough so that the lace end portion 18 can be grasped to pull the main portion 16 of the lace 12 through the second portion 40 of the passage. The second portion 40 preferably has an effective length of about 0.50 inches or less and more preferably has an effective length of about 0.25 inches or less. The illustrated second portion 40 has an upper side length of about 0.50 inches and a lower side length of about 0.25 inches. It is noted that the angled ends of the body 22 effectively reduce the length of the illustrated second portion 40 and the overall length of the passage 32. It should be appreciated that the indicia surface 28 can have an increased length, while still being able to insert the lace 12 through the body passage 32, by having only the second portion 40 of the passage 32 gripping the lace 12.

Figure 27:
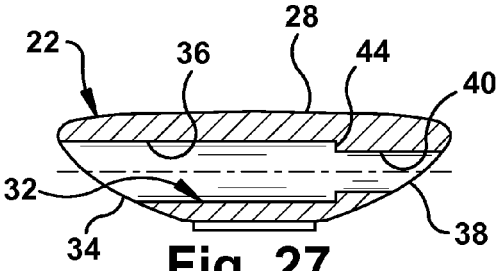
FIG. 27 is a cross-sectional view similar to FIG. 6 but showing a variation of the central passage.
Figure 28:
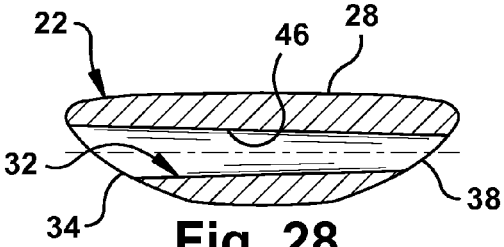
FIG. 28 is a cross sectional view similar to FIGS. 6 and 27 but showing another variation of the central passage.
Figure 29:
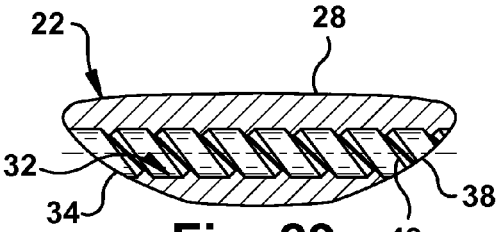
FIG. 29 is a cross sectional view similar to FIGS. 6, 27, and 28 but showing yet another variation of the central passage.
Figure 30:
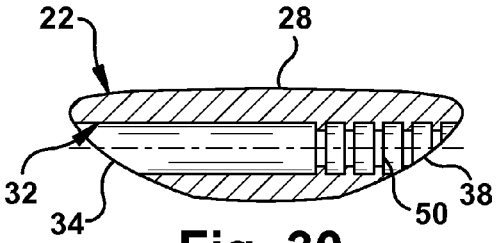
FIG. 30 is a cross sectional view similar to FIGS. 6, and 27 to 29 but showing even yet another variation of the central passage.

FIGS. 27 to 30, illustrate that the passage 32 can alternatively have other suitable geometries which frictionally secure the body 22 onto a desired position along the length of the lace 12. FIG. 27, illustrates that there can alternatively be a step 44 located at the interface between the first and second portions 36, 40 of the passage 32. FIG. 28 illustrates that the passage 32 can have a frusto-conically shaped surface 46 wherein the size of the passage 32 gradually increases from the inlet to the outlet to form a wedge to secure the lace 12. FIG. 29 illustrates that the passage 32 can be provided with a screw thread 48 so that it is rotated to move along the lace 12. FIG. 30 illustrates that the passage 32 can be provided with ridges or other surface textures 50 to frictionally engage the lace 12.

The illustrated body 22 is formed by injection molding but any other suitable method of molding and/or manufacturing can be alternatively utilized. The illustrated body 22 comprises thermoplastic elastomer (TPE) material. It is noted however, that the body 22 can comprise any other suitable plastic material or other suitable type of material. The material can be of any desirable pantone-specific color, combination of colors, clear, or glow-in-the-dark.

To install the accessory 10 onto a standard sized athletic shoe lace 12, the end portion 18 of the lace 12 is inserted into the inlet 34 of the passage 34. With a few twists, the end portion 18 of the lace 12 emerges through the outlet 38 so that the end portion 18 can be grasped and pulled entirely out of the body 22. The accessory 10 can then be pushed or pulled along the length of the lace 12 until it is in a desired position. The accessory 10 stays securely in place at the desired location along the length of the lace 12 due to friction because of the tight fit between the lace 12 and the second portion 40 of the passage 32. For thinner laces 12, like those found on golf shoes, a knot may be required on the end of the lace 12 to keep the accessory in place.

Figure 8:
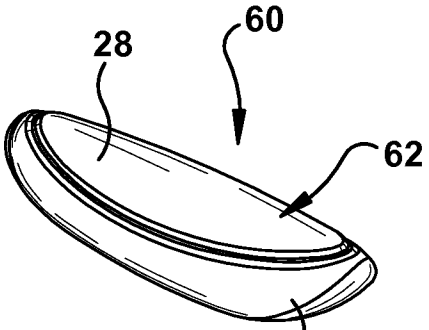
FIG. 8 is perspective view of the decorative and/or promotional accessory of FIG. 1 according to a second preferred embodiment of the present invention.
Figure 9:
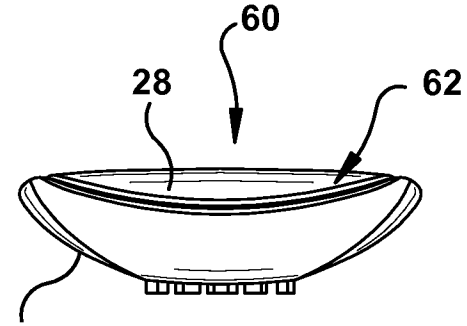
FIG. 9 is a front side elevational view of the decorative and/or promotional accessory of FIG. 8.
Figure 10:
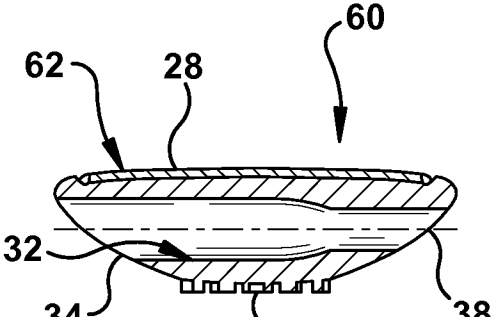
FIG. 10 is a cross-sectional view of the decorative and/or promotional accessory of FIGS. 8 and 9.

FIGS. 8 to 10 illustrate a decorative and/or promotional article or accessory 60 according to a second embodiment of the present invention. The accessory 60 according to the second embodiment is substantially the same as the accessory 10 according to the first embodiment except that the molded plastic body 22 includes a plate or insert 62 forming the upper indicia surface 28. The illustrated insert 62 is a relatively thin sheet which comprises a relatively hard material such as, for example, a hard plastic like acrylonitrile-butadiene-styrene copolymers (ABS) and over molded onto the remainder of the body 22 which preferably comprises a softer material such as, for example, an elastomer like TPE. The illustrated materials are of different colors but alternatively can be of the same color. The illustrated insert 62 provides a smooth hard indicia surface 28 upon which the indicia or message 24 can be printed by any suitable method such as, for example, pad printing. It is noted that the indicia or message 24 can alternatively be provided in any other suitable manner. It should be appreciated that the inserts 62 can be easily customized with different indicia or messages 24 so that the same mold can be used to produce accessories with different indicia or messages 24.

Figure 11:
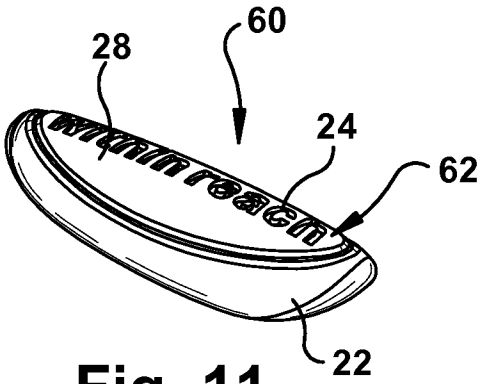
FIG. 11 is perspective view of a variation of the decorative and/or promotional accessory of FIGS. 8 to 10.
Figure 12:
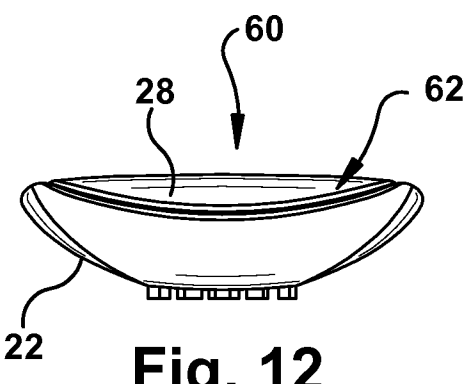
FIG. 12 is a front side elevational view of the decorative and/or promotional accessory of FIG. 11.
Figure 13:
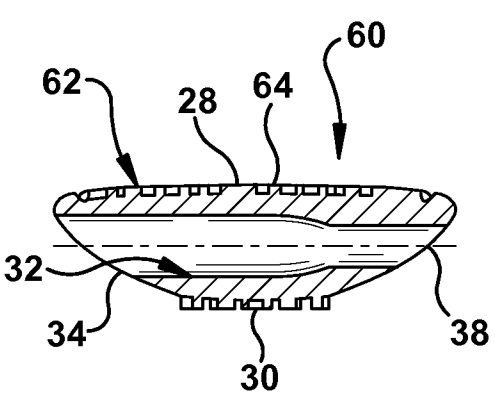
FIG. 13 is a cross-sectional view of the decorative and/or promotional accessory of FIGS. 10 and 11.

FIGS. 11 to 13 illustrate a variation of the accessory 60 according to the second embodiment wherein the indicia or message 24 is formed by openings 64 extending entirely through the thickness of the insert 62. With the insert 62 formed in this manner, the softer material of the lower portion of the body 22 seeps or passes through the openings 64 forming the indicia or message 24 during over molding to create a clean flush appearance.

Figure 14:
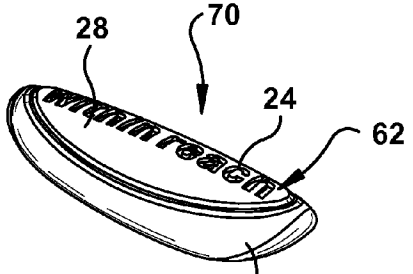
FIG. 14 is a perspective view of the decorative and/or promotional accessory of FIG. 1 according to a third preferred embodiment of the present invention.
Figure 15:
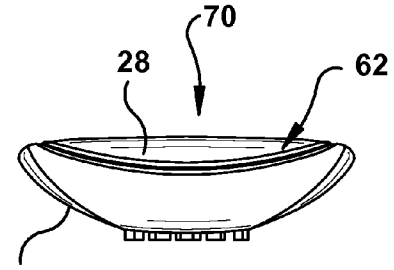
FIG. 15 is a front side elevational view of the decorative and/or promotional accessory of FIG. 14.
Figure 16:
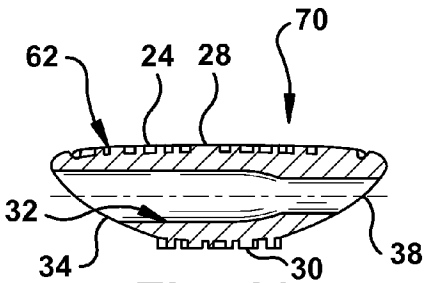
FIG. 16 is a cross-sectional view of the decorative and/or promotional accessory of FIGS. 14 and 15.

FIGS. 14 to 16 illustrate a decorative and/or promotional article or accessory 70 according to a third embodiment of the present invention. The accessory 70 according to the third embodiment is substantially the same as the accessory 60 according to the second embodiment except that the body 22 and the insert 62 comprise the same material. The illustrated body and insert 22, 62 each comprise TPE but any other suitable material can alternatively be utilized. The illustrated indicia or message 24 is molded into the insert 62 in a debossed manner, that is, recessed from the indicia surface 28. It is noted that the indicia or message 24 can alternatively be provided in any other suitable manner.

Figure 17:
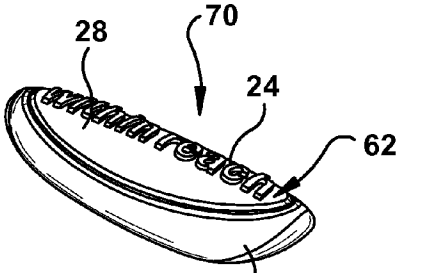
FIG. 17 is a view of a first variation of the decorative and/or promotional accessory of FIGS. 14 to 16.
Figure 18:
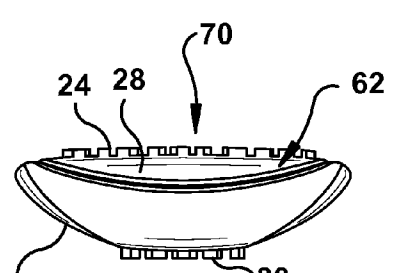
FIG. 18 is a front side elevational view of the decorative and/or promotional accessory of FIG. 17.
Figure 19:
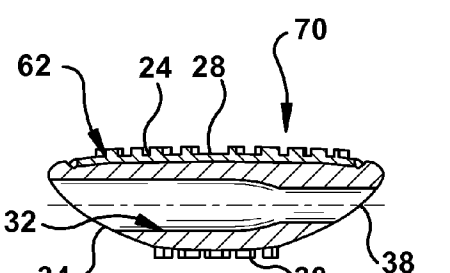
FIG. 19 is a cross-sectional view of decorative and/or promotional accessory of FIGS. 17 and 18.

FIGS. 17 to 19 illustrate a first variation of the accessory 70 according to the third embodiment wherein the indicia or message 24 is molded into the insert 62 in a embossed manner, that is, raised above the indicia surface 28. It is noted that the indicia or message 24 can alternatively be provided in any other suitable manner.

Figure 20:
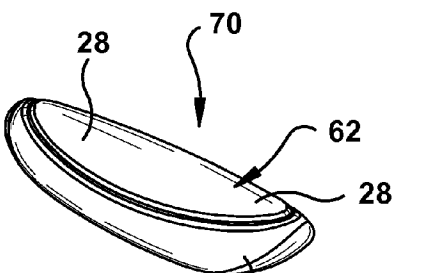
FIG. 20 is a perspective view of a second variation of the decorative and/or promotional accessory of FIGS. 14 to 16.
Figure 21:
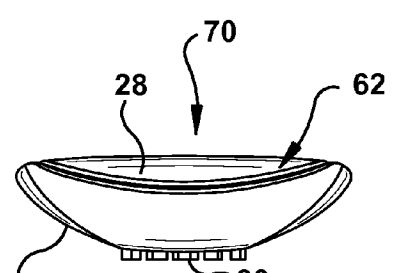
FIG. 21 is a front side elevational view of the decorative and/or promotional accessory of FIG. 20.
Figure 22:
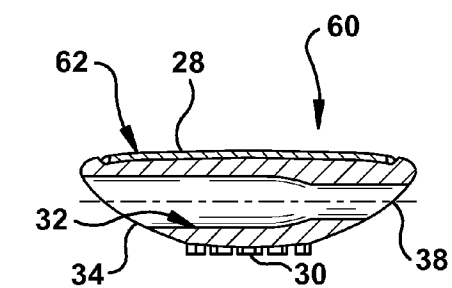
FIG. 22 is a cross-sectional view of the decorative and/or promotional accessory of FIGS. 20 and 21.

FIGS. 20 to 22 illustrate a second variation of the accessory 70 according to the third embodiment wherein the insert 62 provides a smooth indicia surface 28 upon which the indicia or message 24 can be printed by any suitable method such as, for example, pad printing. It is noted that the indicia or message 24 can alternatively be provided in any other suitable manner.

Figure 23:
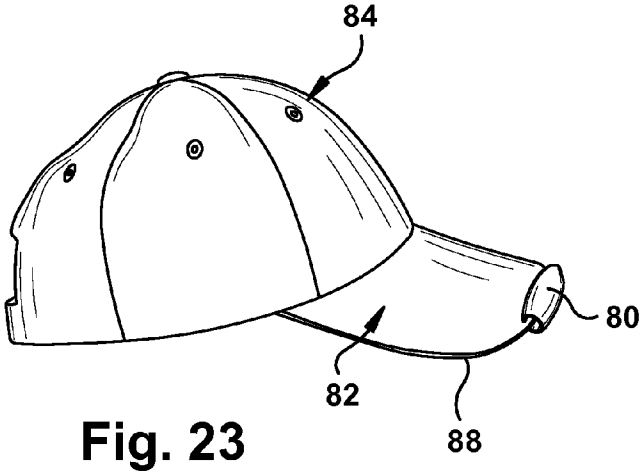
FIG. 23 is a perspective view of a billed cap having a decorative and/or promotional accessory according to the present invention.
Figure 3:
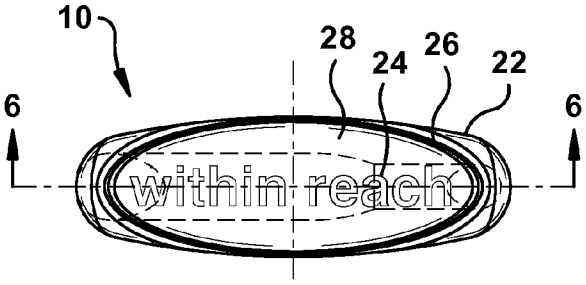
FIG. 3 is a top plan view of the decorative and/or promotional accessory of FIG. 2.
Figure 5:
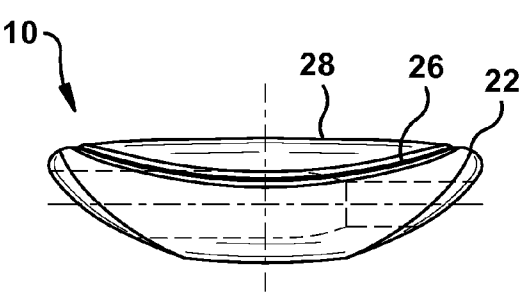
FIG. 5 is a front side elevational view of the decorative and/or promotional accessory of FIGS. 2 to 4.
Figure 6:
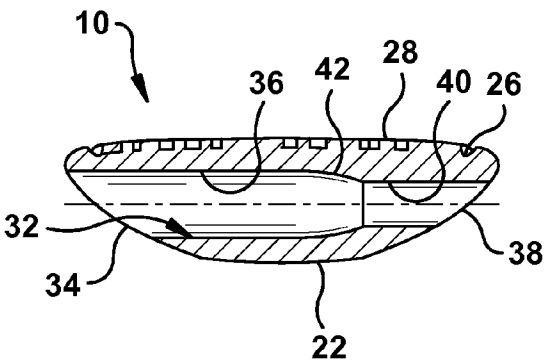
FIG. 6 is a cross-sectional view of the decorative and/or promotional accessory of FIGS. 2 to 5 taken along line 6-6 of FIG. 3.
Figure 4:
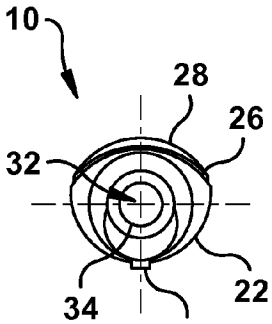
FIG. 4 is an end elevational view of the decorative and/or promotional accessory of FIGS. 2 and 3.
Figure 7:
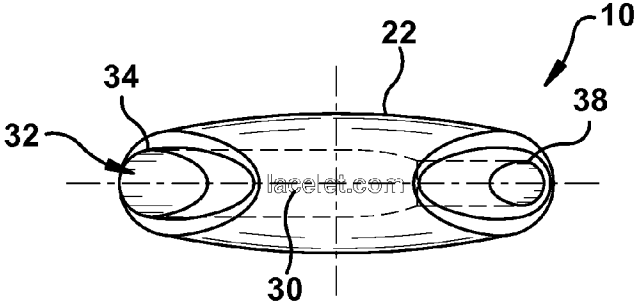
FIG. 7 is a bottom plan view of the decorative and/or promotional accessory of FIGS. 2 to 6.

FIG. 23 illustrates a decorative and/or promotional article or accessory 80 according to a fourth embodiment of the present invention. The illustrated accessory 80 is removably secured to the brim or bill 82 of a hat or cap 84. It is noted that the illustrated accessory 80 can alternatively be secured to any item having a relatively thin edge of material such as but not limited to the bill 82 of a hat or cap 84.

Figure 24:
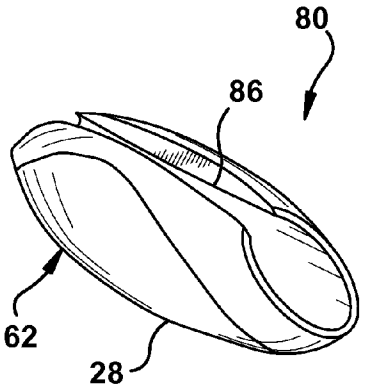
FIG. 24 is a perspective view of the decorative and/or promotional accessory of FIG. 23 according to a preferred embodiment of the present invention.
Figure 25:
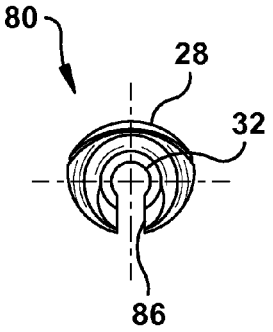
FIG. 25 is an end elevational view of the decorative and/or promotional accessory of FIG. 24.
Figure 26:
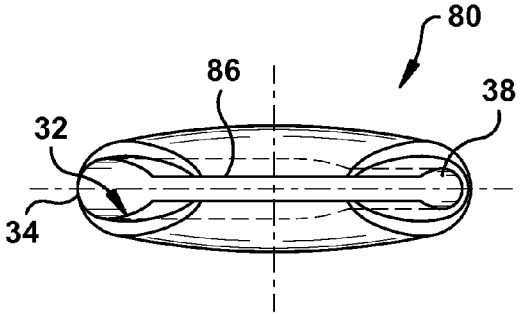
FIG. 26 is a bottom plan view of the decorative and/or promotional accessory of FIGS. 24 and 25.

FIGS. 24 to 26 illustrate the accessory 80 according to a fourth embodiment of the present invention. The accessory 80 is substantially the same as the accessory 60 according to the second embodiment described hereinabove except that a slot 86 is provided on the bottom of the body 22. It is noted that any of the accessories according to the other illustrated embodiments can also be provided with the slot 86. The illustrated slot 86 extends the entire length of the body 22 from the inlet 34 to the outlet 38 and extends entirely through the bottom wall from the exterior surface to the passage 32. The illustrated slot 86 is sized and shaped to receive an edge of the brim or bill 82 so that the accessory 80 can be removably secured to a cap 84 or other suitable item. The slot 86 is preferably provided with a width that is slightly smaller than the thickness of a typical cap bill 82 so that the accessory 80 resiliently grips the bill 82 when the bill 82 inserted therein.

To install the accessory 80 onto a standard sized athletic cap 84, the opposed edges forming the slot 86 are manually pulled apart to increase the width of the slot 86 and the bill 82 of the cap 84 is inserted into the slot 86. The accessory 80 is then released and the edges resiliently snap back to grip the cap bill 82. The accessory 80 stays securely in place at a desired location along the edge 88 of the bill 82 due to friction because of the gripping action at the slot 86.

From the foregoing detailed description, it can be appreciated that the illustrated accessories have many decorative and/or promotional uses due to their low production cost. The accessories are an ideal giveaway to participants who pay a fee to enter athletic or other events such as walks/runs/swims for charity. Awareness is generated on the spot because the accessories can be immediately displayed on shoes, hats, or otherwise. The accessories are well suited for selling at on-site promotions such as live radio remotes, state and county fairs, concerts, amusement parks, festivals and other special events. Businesses can use the accessories as an attention grabbing method to display their corporate image or motto via tradeshows or internal events. The accessories also can be an inexpensive giveaway for employees, customers, and prospects. The accessories are an affordable fundraising incentive for schools, charities and other worthwhile causes. The accessories can be purchased at a relatively low price leaving a desirable profit for the fundraiser. A glow-in-the-dark accessory is an optimal giveaway for running, biking, walking, or other night time outdoor activities. The accessories can be used to promote the cause of our troops overseas, commemorate events like 9/11, honor local heroes like police and fire fighters, and more.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An accessory to be secured to a lace comprising, in combination:

a generally elongate and cylindrically shaped molded plastic body having a first opening, a second opening, and a passage that extends from the first opening to the second opening, the passage including a first portion having a first diameter, a second portion having a second diameter smaller than the first diameter, and a taper portion connecting the first portion and the second portion, wherein the second portion is sized and shaped to receive the lace and to engage and frictionally grip the lace within the body to secure the body in a desired position along the lace, and wherein the body can be pushed and pulled along the lace to the desired position and the body stays securely in place at the desired position by friction due to a tight fit; and indicia provided on an exterior surface of the accessory.

2. The accessory according to claim 1, wherein the body is molded of plastic, and further comprising a molded plastic insert fixed to the body and forming at least a portion of the exterior surface of the accessory, and wherein the indicia is provided on the portion of the exterior surface of the accessory formed by the insert.

3. The accessory according to claim 2, wherein the body comprises a first plastic material the insert comprises a second plastic material and the second plastic material has a hardness greater than the first plastic material.

4. The accessory according to claim 2, wherein the body and the insert are each molded of the same plastic material.

5. The accessory according to claim 1, wherein the first portion of the passage extends from the first opening to the taper portion and the second portion of the passage extends from the second opening to the taper portion.

6. The accessory according to claim 1, wherein only the second portion of the passage frictionally grips the lace.

7. An accessory comprising:

an elongate and cylindrically shaped body including:

a first opening;

a second opening disposed at an opposite end of the first opening;

a channel longitudinally extending from the first opening to the second opening;

a top portion having a first radius, a top surface, and indicia provided on the top surface;

a bottom portion having a second radius and a bottom surface, wherein the first radius is larger than the second radius such that the top surface of the top portion is broader than the bottom surface of the bottom portion.

8. The accessory according to claim 1, wherein the passage is provided with a helical thread.

9. The accessory according to claim 1, wherein the passage is provided with surface texture.

10. The accessory according to claim 1, wherein an upper side of the accessory has a radius which is larger than a radius of the bottom side of the accessory so that the upper side is flatter than the bottom side and the indicia is provided on the upper side.

11. The accessory according to claim 1, wherein the passage is provided with ridges.

12. The accessory according to claim 2, wherein the body is injection molded onto the insert.

13. The accessory according to claim 2, wherein the indicia is printed onto the insert with ink.

14. The accessory according to claim 2, wherein the indicia is formed by openings in the insert.

15. The accessory according to claim 14, wherein plastic material of the body extends into the openings in the insert.

16. The accessory according to claim 2, wherein the indicia is molded in the insert in a debossed manner.

17. The accessory according to claim 2, wherein the indicia is molded in the insert in an embossed manner.

18. The accessory according to claim 7, wherein the channel is frusto-conical shaped from the first opening to the second opening to wedge the lace within the passage.

19. The accessory of claim 7, wherein the accessory is a promotional accessory and wherein the channel is configured to receive, engage, and frictionally grip a shoe lace to secure the body in a desired position along the shoe lace and wherein the body can be moved along the shoe lace to the desired position.

20. The accessory of claim 7, wherein the accessory is a promotional accessory and wherein the channel is configured to receive, engage, and frictionally grip a brim of a hat to secure the body in a desired position along the brim and wherein the body can be moved along the brim to the desired position.

* * * * *